US005555076A

United States Patent [19]

Yoshiyama

[11] Patent Number: 5,555,076

[45] Date of Patent: Sep. 10, 1996

[54] APPARATUS FOR CONTROLLING AN EXPOSURE

[75] Inventor: Tsugihito Yoshiyama, Toyohashi, Japan

[73] Assignee: Minolta Co., Ltd., Osaka, Japan

[21] Appl. No.: 359,546

[22] Filed: Dec. 20, 1994

[30] Foreign Application Priority Data

Dec. 22, 1993 [JP] Japan ..... 5-323809

[51] Int. Cl.[6] ..... G03G 21/00

[52] U.S. Cl. ..... 355/208; 355/69; 355/71

[58] Field of Search ..... 355/228, 229, 355/69, 71, 208, 214

[56] References Cited

U.S. PATENT DOCUMENTS

| | | | |
|---|---|---|---|
| 4,113,373 | 9/1978 | Eppe et al. | 355/71 X |
| 4,306,804 | 12/1981 | Sakamoto et al. | 355/71 X |
| 4,348,099 | 9/1982 | Fantozzi | 355/71 X |
| 4,699,494 | 10/1987 | Honda | 355/228 |
| 4,707,122 | 11/1987 | Lama et al. | 355/71 |
| 4,714,945 | 12/1987 | Fujiwara et al. | 355/69 |
| 5,134,439 | 7/1992 | Zuber | 355/214 |

FOREIGN PATENT DOCUMENTS 61-277938 12/1986 Japan .

*Primary Examiner*—Robert Beatty

*Attorney, Agent, or Firm*—Burns, Doane, Swecker & Mathis, L.L.P.

[57] ABSTRACT

An apparatus for controlling an exposure in an image forming apparatus includes an exposure unit which varys the illumination from an exposure light source in accordance to photoreceptor sensitivity and projects the light reflected onto a photoreceptor, and a light reducing filter adjusting a quantity of light to be projected according to the sensitivity of the photoreceptor. The neutral-density filter may be employed as the reducing filter. Preferably, this filter is movable between a first position in a path of the reflected light and a second position out of the path. The photoreceptor having a thicker photosensitive layer may be used to its long life period.

8 Claims, 2 Drawing Sheets

APPARATUS FOR CONTROLLING AN EXPOSURE

BACKGROUND OF THE INVENTION

1. Field of the Invention

The present invention relates to an apparatus for controlling a quantity of light to be projected on an electrostatic latent image bearing member such as photoreceptor which is generally used in an electrophotographic image forming apparatus such as copier, thermal printer, inkjet printer and facsimile machines.

2. Description of the Prior Art

An image forming apparatus such as an electrophotographic copy machine comprises an electrostatic latent image bearing member, i.e., photoreceptor having a photosensitive layer thereon. The photosensitive layer has a thickness that decreases with time of use, accompanied by decrease in sensitivity. In order to offset the decrease in sensitivity to thereby keep making an image having a suitable density, there is proposed a method in which the quantity of light emitted from an exposure light-source is controlled by adjusting a voltage to be applied to the light source in accordance with the reduction in thickness of the photosensitive layer, i.e., the decrease of sensitivity thereof. In reality, however, the method may not accomplish its purpose, because an available controlling range of the light quantity based on the voltage adjustment is restricted and an excessive reduction in voltage results in a unstable and uneven exposure.

Further, although a new photoreceptor having a thicker photosensitive layer formed thereon is proposed for the purpose of extending a lifetime thereof, the above mentioned restriction in voltage to be applied to the light-source renders the photoreceptor unable to work over its long service life.

SUMMARY OF THE INVENTION

It is therefore an object of the present invention to provide an improved apparatus for controlling an exposure in an image forming apparatus, which comprises an exposure unit which illuminates a document by a light from an exposure light source and projects the light reflected from the document onto a photoreceptor; and a light reducing filter which adjusts the quantity of the reflected light to be projected in accordance with the sensitivity of the photoreceptor. A neutral-density filter may be employed as the light reducing filter. It is preferable that this filter is movable between a first position located in a path of the reflected light to reduce the light quantity and a second position located out of the path. The filter is set in the first position while the sensitivity is higher than a predetermined level, while the filter is set in the second position while the sensitivity is lower than the predetermined level. The apparatus preferably comprises a controller which controls the quantity of light emitted from the light source.

Another aspect of the present invention comprises an exposure unit which illuminates a document by a light from an exposure light source and projects the light reflected from the document onto a photoreceptor; a detector which detects the sensitivity of the photoreceptor; a light reducing filter which is movable between a first position located in a path of the reflected light to reduce the quantity of the reflected light to be projected and a second position located out of the path; and a first controller which moves the light reducing filter from the first position to the second position if the sensitivity decreases to a predetermined level. A neutral-density filter may be employed as the light reducing filter. This apparatus may also include a second controller which controls the quantity of the emitted light from the exposure light source in steps in accordance with the sensitivity. The quantity of the light to be projected onto the photoreceptor may be controlled by the second controller, with the light reducing filter set in the first position, while the sensitivity is higher than the predetermined level. On the other hand, the quantity of the light to be projected onto the photoreceptor may be controlled by the second controller, with the light reducing filter set in the second position, while the sensitivity is lower than the predetermined level.

A further aspect of the present invention comprises an exposure unit which illuminates a document by a light from an exposure light source and projects the light reflected from the document onto a photoreceptor; a first detector which detects the sensitivity of the photoreceptor; a first controller which controls the quantity of the emitted light from the exposure light source in steps in accordance with the sensitivity; a second detector which detects the quantity of the emitted light from the exposure light source; a light reducing filter which is movable between a first position located in a path of the reflected light to reduce the quantity of the light to be projected and a second position located out of the path; and a second controller which moves the light reducing filter from the first position to the second position when the quantity of the emitted light from the light source reaches an uppermost level. A neutral-density filter is preferably employed as the light reducing filter. The quantity of the light to be projected may be controlled by the first controller with the light reducing filter set in the first position, before the quantity of the light emitted from the light source reaches an uppermost level.

According to the present invention, a suitable quantity of light is projected onto the photoreceptor in accordance with the sensitivity of the photoreceptor. Further, by changing the position of the neutral density filter mounted for movement between the first position located in the light path and the second position located out of the light path and controlling the voltage to be applied to the exposure light source, it is possible to extensively control the light quantity to be projected onto the photoreceptor. Further, a photoreceptor having a thicker photosensitive layer may be used to the full extent of its long life period.

BRIEF DESCRIPTION OF THE DRAWINGS

These and other objects and features of the present invention will become clear from the following description taken in conjunction with a preferred embodiment thereof with reference to the accompanying drawings throughout which like parts are designated by like reference numerals, and in which.

DETAILED DESCRIPTION OF THE PREFERRED EMBODIMENTS

Figure 1:
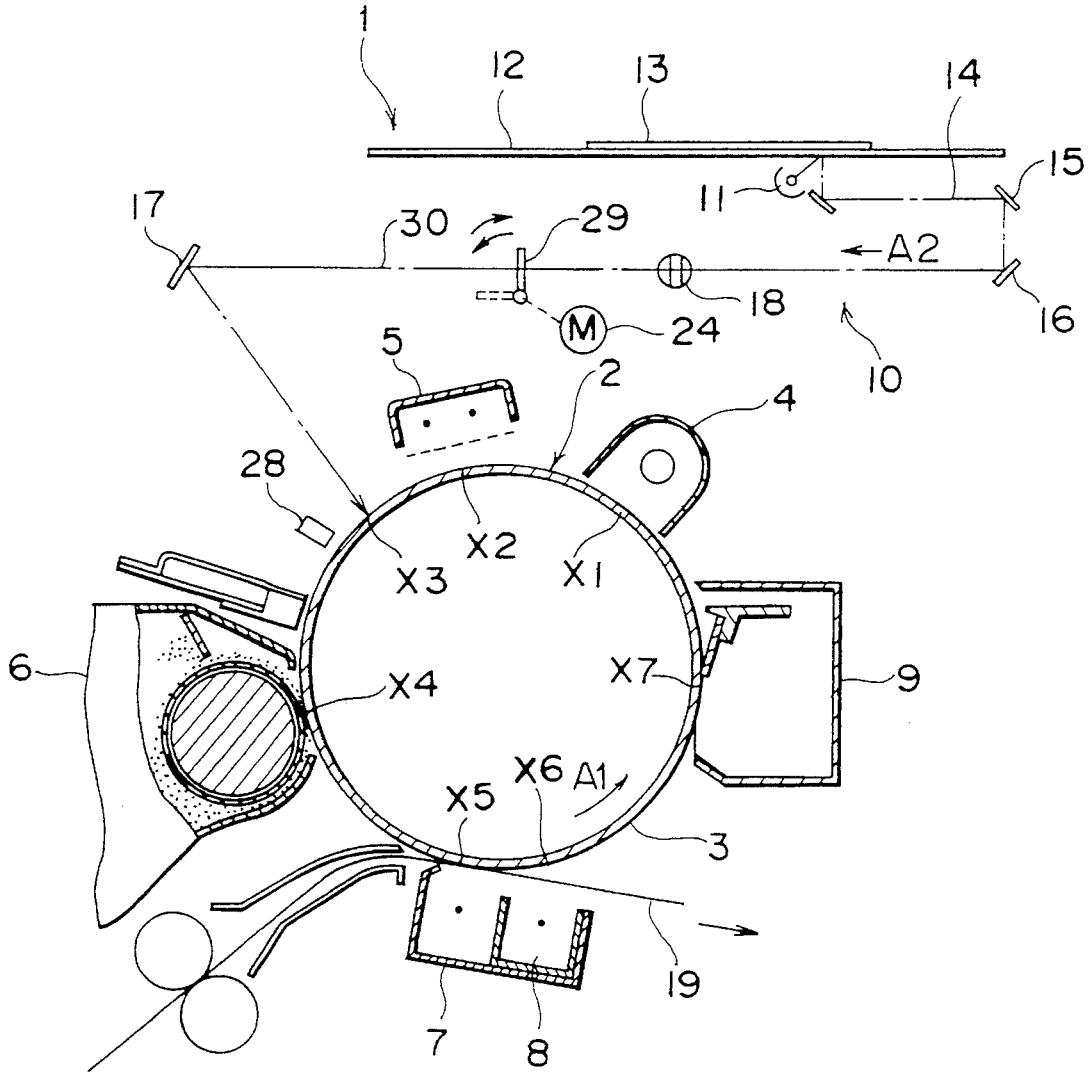
FIG. 1 is a schematic view of an image forming portion of a copy machine.

Referring now to the drawings, there is shown in FIG. 1 a general view of an image forming portion of an electrophotographic copy machine. The image forming portion generally indicated by numeral 1 comprises an electrostatic latent image bearing member, i.e., photoreceptor 2. The photoreceptor 2, which comprises a cylindrical drum having an organic photosensitive layer 3 of a specific thickness on its outer surface, is mounted for rotation in the direction indicated by arrow A1 by a driving motor not shown. Arranged around the photoreceptor 2 in order with respect to the direction of rotation thereof are an erasing unit 4, a charging unit 5, a developing unit 6, a transfer unit 7, a detaching unit 8, and a cleaning unit 9. Also, an exposure unit 10 is disposed above the photoreceptor 2.

An image forming process of this copy machine 1 will be discussed below briefly. The photoreceptor 2 rotates in the arrow-headed direction A1. The photosensitive layer 3 moving past an erasing station X1 are successively illuminated by the erasing unit 4 so that a residual electric charge on the photosensitive layer 3 is erased therefrom. The charging unit 5 electrically charges the photosensitive layer 3 to a predetermined voltage at a charging station X2. In the exposure unit 10, an exposure lamp 11 illuminates a bottom surface of a document 13 placed on the glass platen 12 while it moves along and below the platen 12 in the direction indicated by arrow A2. The reflected light beam 14 from the document 13 travels through reflecting mirrors 15, 16, and 17, and lens 18 and is finally projected onto the charged photosensitive layer 3 to form an electrostatic latent image corresponding to an image of the document 13. The developing unit 6 conveys a developing material including toner to a developing station X4 and brings it into contact with the photosensitive layer 2, such that the electrostatic latent image is developed by the developing material into a visible toner powder image. The transfer unit 7 transfers the toner powder image onto a sheet 19 transported to a transfer station X5. The detaching unit 8 detaches at a detaching station X6 the sheet 19 adhering the toner image transferred from the photoreceptor 2. This sheet 19 is then transported to a fusing station not shown so that the toner image is permanently fixed on the sheet. At a cleaning station X7, the cleaning unit 9 removes a residual toner which has not been transferred to the sheet 19 from the photoreceptor 2, in readiness for the next succeeding cycle of copy making.

Figure 2:
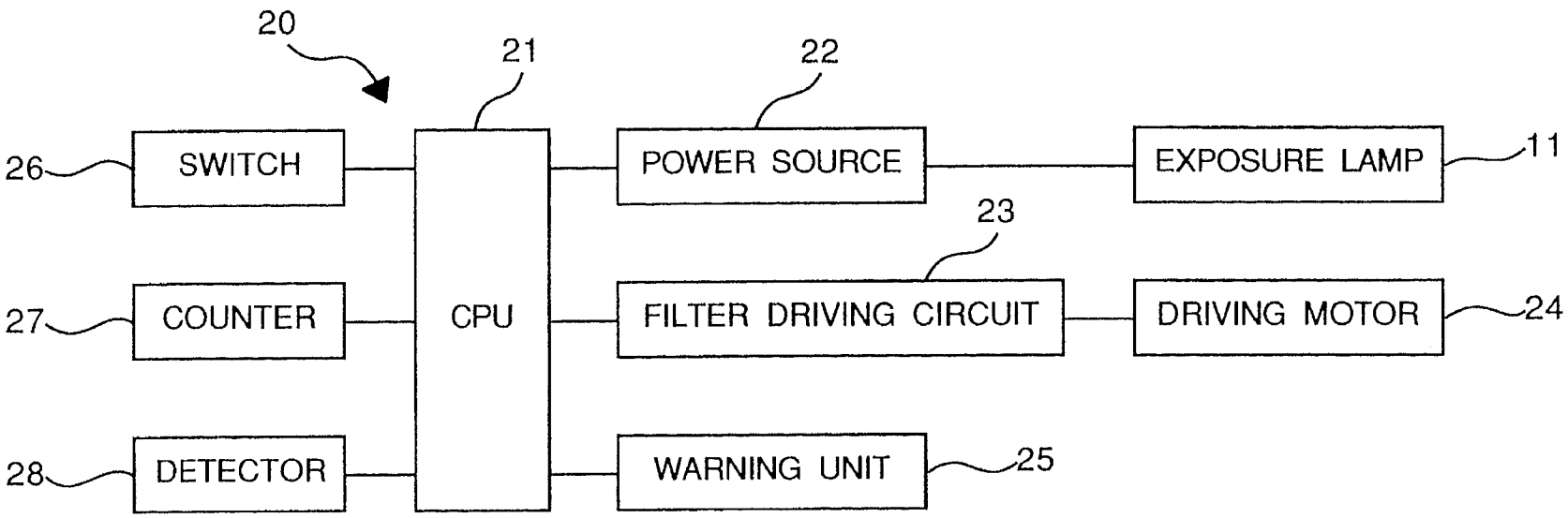
FIG. 2 is a block diagram showing a control circuit used in an apparatus of the present invention.

Referring to FIG. 2, a control unit for controlling the exposure unit of the present invention, which is generally indicated by numeral 20, will be discussed hereinafter. The control unit 20 includes a central processing unit (CPU) 21 to which a power source 22, a filter driving circuit 23, a warning unit 25, a switch 26, a counter 27 and a detector 28 are electrically connected.

The power source 22 is electrically connected to the exposure lamp 11 so that a voltage to be applied to the exposure lamp 11 and the quantity of emitting light thereof are controlled according to an output from the CPU 21 to the power source 22. The filter driving circuit 23 is also electrically connected to a driving motor 24. This motor 24 is drivingly coupled with an extinction filter (light reducing filter) 29 disposed in the exposure unit 10 so that the filter 29 can move between two positions, i.e., a first position located in a path 30 of the image beam 14 which is shown by a solid line in FIG. 1, and a second position located out of the path 30 which is shown by a dotted line, on the basis of an output from the filter driving circuit 23 to the driving motor 24. A neutral-density filter having no selectivity with respect to the wavelength within the band of visible light is preferably used as the extinction filter 29. The warning unit 25 includes a display device and/or a sound device for cautioning the photosensitive layer 3 of the photoreceptor 2 has reached its life period. The counter 27, whose memory is reset by the switch 26, sums up a total rotation time or a total rotation number of the photoreceptor 2 which is presently equipped in the copy machine.

Control of the quantity of light to be projected onto the photoreceptor 2 by the unit 20 will be discussed hereinafter. When a new photoreceptor 2 is equipped and then the switch 26 is turned on by an operator, the counter 27 is reset by the signal from the CPU 21. The CPU 21 further provides the filter driving circuit 23 with a signal which instructs to drive the motor 24 so that the filter 29 moves from the second position to the first position to thereby reduce the quantity of light to be projected onto on the photoreceptor 2. At the same time or just before or after that, the output voltage of the power source 22 is set to a predetermined lowermost level.

When the image forming process using the new photoreceptor 2 is started, the exposure lamp 11 is provided with the lowermost voltage. Therefore, the exposure lamp 11 emits the light having the lowermost light quantity towards the document, and the reflected light beam therefrom is further dimmed by the extinction filter 29. The lowermost voltage applied to the exposure lamp 11 should be determined such that the light beam dimmed by the extinction filter 29 ensures on the new photoreceptor 2 a predetermined quantity of exposing light required for making a clear image.

During the image forming process using the new photoreceptor 2, the number of rotation of the photoreceptor 2 is summed up by the counter 27. The thickness of the photosensitive layer 3 and the sensitivity based thereon decreases linearly with time of use or increase of the number of rotation of the photoreceptor 2, and therefore the rest of the lifetime of the photoreceptor 2 may be determined by means of the number of rotation counted by the counter 27.

As the total number of the counter 27 added up to the specified number, the CPU 21 directs the power source 22 to increase its output voltage to a predetermined level, which increases the quantity of light to be emitted from the exposure lamp 11 to eventually offset the reduction in sensitivity of the photoreceptor 2. By repetition of this process, the output of the power source 22 and the quantity of light to be projected onto the photoreceptor 2 is changed stepwise in accordance with increase of the total number of rotation of the photoreceptor 2.

When the total rotation number of photoreceptor 2 is summed up to a predetermined number while a predetermined uppermost voltage is applied to the exposure lamp 11, the CPU 21 provides the filter driving circuit 23 with a signal to drive the motor 24 so that the filter 29 moves out of the path 30 of the light beam 14. The CPU 21 also provides the power source 22 with another signal to change the output voltage thereof to be applied to the exposure lamp 11 down to the lowermost level. It should be adjusted that the increase of the quantity of light caused by movement of the filter 29 out of the path 30 fully covers the decrease of quantity of light caused by changing the output voltage from the uppermost level to the lowermost one and an excessive increase or decrease in quantity of light to be projected onto on the photoreceptor 2 is prevented.

After that the voltage applied to the exposure lamp 11 is increased whenever the counter 27 counts the specific additional rotation number, which offsets reduction in sensitivity of the photoreceptor 2. This operation is repeated until the output voltage of the power source 22 reaches the predetermined uppermost level. If the rotation number of the photoreceptor 2 is summed up to a specific number while the uppermost voltage is applied thereto, the CPU 21 directs the warning unit 25 to warn that the photoreceptor 2 should be changed by a new one.

Both the uppermost and lowermost voltages applied to the exposure lamp 11 are preferably so selected that the exposure lamp 11 emits a stable light even when any voltage between the uppermost and lowermost levels is applied thereto. Further, the voltage range from the lowermost to uppermost is suitably set to about from 10 to some dozens of volt. Furthermore, the voltage range increased when the total sum of the rotation number is added by the predetermined number is preferably set to about from one to several volt.

A filter having a transmissivity of from about 40 to 80 percent is preferably used as the extinction filter 29. The reasons is that it is practical to set the variable range of image density by adjusting the light quantity of the exposure lamp 11 to about 0.2, and it is suitable that the difference in density of images made on conditions that the extinction filter 29 is in the first position and in the second position, respectively, is 0.1 or more.

Although in the embodiment of the invention previously described the duration of the photoreceptor 2 is estimated by the total rotation number thereof, since both the sensitivity of the photoreceptor 2 against electronic charging and the reduction in surface voltage thereof by the exposure change based on its deterioration, a detector 28 for measuring the surface voltage of the photoreceptor 2 may be disposed between the exposure station X3 and developing station X4 for estimating the deterioration of the photoreceptor 2 by measuring a voltage of a test pattern of electrostatic latent image made on the photoreceptor 2.

Further, a plurality of extinction filters each having higher transmissivity may be so arranged as to move between two positions, a first position located in the path of light and a second position located out of the path, respectively, such that the quantity of light may be changed in many steps.

Furthermore, it is not limited to the extinction filter which reduces the light quantity of the image beam, and any member which is capable of controlling the light quantity by adjusting an area or aperture where the light passes through may be employed.

It should be noted that the present invention will be applied not only to the copy machine, but also to other image forming apparatuses such as thermal printer, inkjet printer and facsimile machines.

Although the present invention has been fully described in connection with the preferred embodiment thereof with reference to the accompanying drawings, it is to be noted that various changes and modifications are apparent to those skilled in the art. Such changes and modification are to be understood as included within the scope of the present invention as defined by the appended claims unless they depart therefrom.

What is claimed is:

1. An apparatus for controlling an exposure in an image forming device, comprising:

an exposure light source which emits light so as to illuminate a document;

projection means for projecting light reflected from said document onto a photoreceptor;

a detector which detects the sensitivity of said photoreceptor;

a movable light reducing filter which optically adjusts the quantity of light reflected from said document and projected onto said photoreceptor when said movable light reducing filter is located in a path of said light; and an exposure light controller which electrically adjusts the quantity of light reflected from said document by controlling a voltage to be applied to said exposure light source, wherein said exposure light controller controls said voltage with said movable light reducing filter located in said light path so as to adjust the quantity of light reflected from said document when the sensitivity detected by said detector is greater than a first predetermined level, and said exposure light controller controls said voltage so as to adjust the quantity of said light reflected from said document with said movable light reducing filter positioned out of said light path when the sensitivity detected by said detector is less than said first predetermined level.

2. The apparatus according to claim 1, wherein said light reducing filter is a neutral-density filter.

3. The apparatus according to claim 1, wherein said voltage is gradually increased in accordance with said sensitivity detected by said detector until said sensitivity detected by said detector corresponds to said first predetermined level.

4. The apparatus according to claim 1, wherein said voltage is decreased when said sensitivity detected by said detector corresponds to said first predetermined level.

5. The apparatus according to claim 4, further comprising an alarm means for indicating the end of a useful lifetime of said photoreceptor when said sensitivity detected by said detector corresponds to a second predetermined level which is lower than said first predetermined level.

6. The apparatus according to claim 5, wherein said voltage is gradually increased in accordance with said sensitivity detected by said detector until said sensitivity detected by said detector corresponds to said second predetermined level.

7. An apparatus for controlling an exposure in an image forming apparatus, comprising:

an exposure light source which emits light so as to illuminate a document, wherein the quantity of emitted light from said exposure light source is changed by controlling a voltage applied to said exposure light source;

projection means for projecting light reflected from said document onto a photoreceptor, said projection means including a movable light reducing filter for reducing a quantity of light projected onto said photoreceptor when said light reducing filter is located in a light path, said light reducing filter being movable between a first position which is in said light path and a second position which is out of said light path;

a detector which detects a deterioration of the sensitivity of said photoreceptor;

a controller which controls said voltage in accordance with said deterioration detected by said detector with said movable light reducing filter located in said first position when said deterioration detected by said detector is less than a first predetermined level, and which moves said movable light reducing filter from said first position to said second position when said deterioration detected by said detector corresponds to said first predetermined level, and which controls said voltage in accordance with said deterioration detected by said detector with said movable light reducing filter located in said second position when said deterioration detected by said detector is less than a second predetermined level which is greater than said first predetermined level, and which indicates an end of a useful lifetime of said photoreceptor and interrupts the controlling of said voltage when said deterioration detected by said detector corresponds to said second predetermined level.

8. An image forming apparatus comprising:

a light source which emits light and exposes a photoreceptor to form an image on said photoreceptor;

a detector which detects the sensitivity of said photoreceptor; and an adjustment means for adjusting an exposure amount of said light in accordance with said sensitivity detected by said detector, said adjustment means including an optical filter which reduces said exposure amount and a controller which varies electric power to be applied to said light source, wherein said adjustment means coarsely adjusts said exposure amount by positioning said filter in a light path and out of said light path, and finely adjusts said exposure amount by controlling said electric power.

* * * * *